US011969124B1

(12) United States Patent
Carrell et al.

(10) Patent No.: US 11,969,124 B1
(45) Date of Patent: Apr. 30, 2024

(54) COLLAPSIBLE PORTABLE TOILET CHAIR

(71) Applicants: Eddie Carrell, The Woodlands, TX (US); Porschette Carrell, The Woodlands, TX (US)

(72) Inventors: Eddie Carrell, The Woodlands, TX (US); Porschette Carrell, The Woodlands, TX (US)

( * ) Notice: Subject to any disclaimer, the term of this patent is extended or adjusted under 35 U.S.C. 154(b) by 0 days.

(21) Appl. No.: 18/066,712

(22) Filed: Dec. 15, 2022

(51) Int. Cl.
*A47K 11/04* (2006.01)
*A47D 1/02* (2006.01)

(52) U.S. Cl.
CPC ..... *A47K 11/04* (2013.01); *A47D 1/02* (2013.01)

(58) Field of Classification Search
CPC ..... A47K 11/04; A47D 1/02
USPC ..... 4/483
See application file for complete search history.

(56) References Cited

U.S. PATENT DOCUMENTS 3,105,665 A * 10/1963 Starkweather ..... A47D 3/005 248/101
6,647,560 B1 11/2003 Hingley et al.
6,889,393 B1 * 5/2005 Rinaldo ..... A47K 11/04 4/484
7,883,143 B2 * 2/2011 Reynolds ..... A47D 1/02 297/16.2

* cited by examiner

*Primary Examiner* — Huyen D Le
(74) *Attorney, Agent, or Firm* — Norton Rose Fulbright US LLP

(57) ABSTRACT

A new and innovative collapsible and portable toilet chair is provided that may, for example, be used for potty training a child. The toilet chair includes a base portion and a seat portion that are each movable between an extended state for use and a collapsed state for portability. The seat portion may be removable from the base portion. The toilet chair can remain a single unit and is compact when in the collapsed state. From the collapsed state, the toilet chair may be pulled outward into the extended state. A bag for collecting a child's waste may be positioned on the seat portion and supported by a flexible support member extending from the seat portion. The toilet chair can be positioned on the ground anywhere and used anytime a child needs a toilet. The toilet chair is therefore beneficial for traveling outside of the home with a child.

20 Claims, 5 Drawing Sheets

COLLAPSIBLE PORTABLE TOILET CHAIR

BACKGROUND

When potty training a child, various potty training chairs may be used to aid the child. Potty training the child outside of a home, however, can pose challenges. Likewise, an already potty trained child needing a toilet can also pose similar challenges. For example, the child may need to use a toilet at an inconvenient time or place where a toilet is not available. In another example, the only available toilet may be in a gas station or rest stop while traveling on a road trip and the condition of that gas station or rest stop toilet might be less than desired. In another example still, there may not be access to a toilet at all regardless of convenience, such as on a camping trip in the wilderness. Bringing a potty training chair or the like with when outside the home can be a solution to these challenges. Many typical potty training chairs, however, are bulky and cumbersome and therefore not readily portable (e.g., cannot be placed in a small bag), and those typical potty training chairs that are readily portable leave room for improvement.

SUMMARY

The present disclosure provides embodiments of a new and innovative collapsible and portable toilet chair. The toilet chair includes a base portion and a seat portion that are each movable between an extended state for use and a collapsed state for portability. When in the collapsed state, the toilet chair can remain a single unit and is compact such that the toilet chair may be placed in a bag (e.g., a diaper bag) for transport. To prepare a collapsed toilet chair for use, the toilet chair may simply be pulled outward into the extended state. A bag for collecting a child's waste may be positioned on the seat portion and supported by a flexible support member extending from the seat portion. At least one bag attachment member included on the seat portion holds the bag in place. With the bag held in place, a child sits directly on the seat portion of the chair and the bag collects the child's waste. The bag can be separated from the bag attachment member(s) and removed from the flexible support member after the child's waste has been collected. In some embodiments, the seat portion is removable from the base portion, which can make it easier to wash (e.g., in a washing machine) the seat portion.

The provided toilet chair is therefore beneficial for traveling outside of the home with a child, such as a child that is potty training. For instance, the toilet chair can be positioned on the ground anywhere and can therefore be used anytime and anywhere a child needs a toilet. Additionally, the toilet chair can serve as a hygienic alternative to a public toilet for a child, when the public toilet is in an undesirable condition.

In an example, a collapsible toilet chair includes abase member movable between an extended state and a collapsed state; and a flexible seat member attached to the base member. The flexible seat member is configured to support a seated child and includes: an opening, a flexible support member extending from the flexible seat member at the opening, and a bag attachment member configured to removably attach a first portion of a bag to the flexible seat member while a second portion of the bag is positioned against the flexible support member.

In an example, a collapsible toilet chair includes abase member movable between an extended state and a collapsed state; and a flexible seat member removably attached to the base member. The base member includes a plurality of support rods including a first support rod, a second support rod, a third support rod, and a fourth support rod, wherein the first support rod is attached to and pivotable about a first mount, wherein the second support rod is attached to and pivotable about a second mount, and wherein a middle portion of the first support rod is attached to and pivotable about a middle portion of the second support rod. The third support rod is attached to and pivotable about the first mount, the fourth support rod is attached to and pivotable about the second mount, and an end portion of the third support rod is attached to and pivotable about an end portion of the fourth support rod. The flexible seat member is configured to support a seated child and includes: an opening, a mesh support member extending from the flexible seat member at the opening, and first and second bag attachment members configured to respectively removably attach first and second portions of a bag to the flexible seat member while a third portion of the bag is positioned against the mesh support member.

In an example, a system includes a disposable bag and a collapsible toilet chair. The collapsible toilet chair includes: a base member movable between an extended state and a collapsed state, and a flexible seat member removably attached to the base member. The flexible seat member is configured to support a seated child and includes: an opening, a mesh support member extending from the flexible seat member at the opening in a same direction as the base member, and first and second bag attachment members configured to respectively removably attach first and second portions of the disposable bag to the flexible seat member while a third portion of the disposable bag is positioned against the mesh support member.

Additional features and advantages of the disclosed method and apparatus are described in, and will be apparent from, the following Detailed Description and the Figures. The features and advantages described herein are not all-inclusive and, in particular, many additional features and advantages will be apparent to one of ordinary skill in the art in view of the figures and description. Moreover, it should be noted that the language used in the specification has been principally selected for readability and instructional purposes, and not to limit the scope of the inventive subject matter.

DETAILED DESCRIPTION

Figure 1:
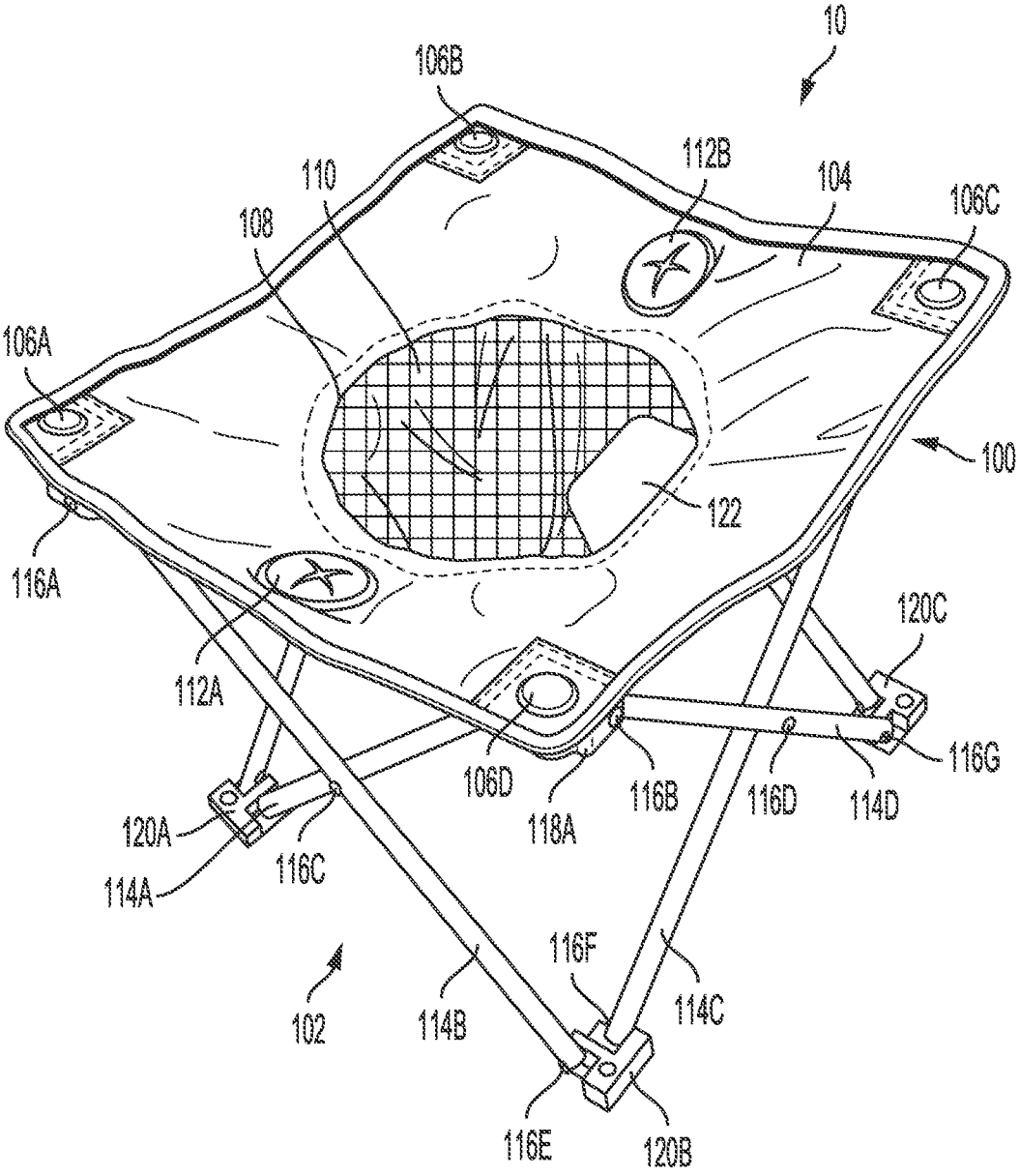
FIG. 1 illustrates a perspective view of a collapsible toilet chair in an extended state, according to an aspect of the present disclosure.
Figure 2:
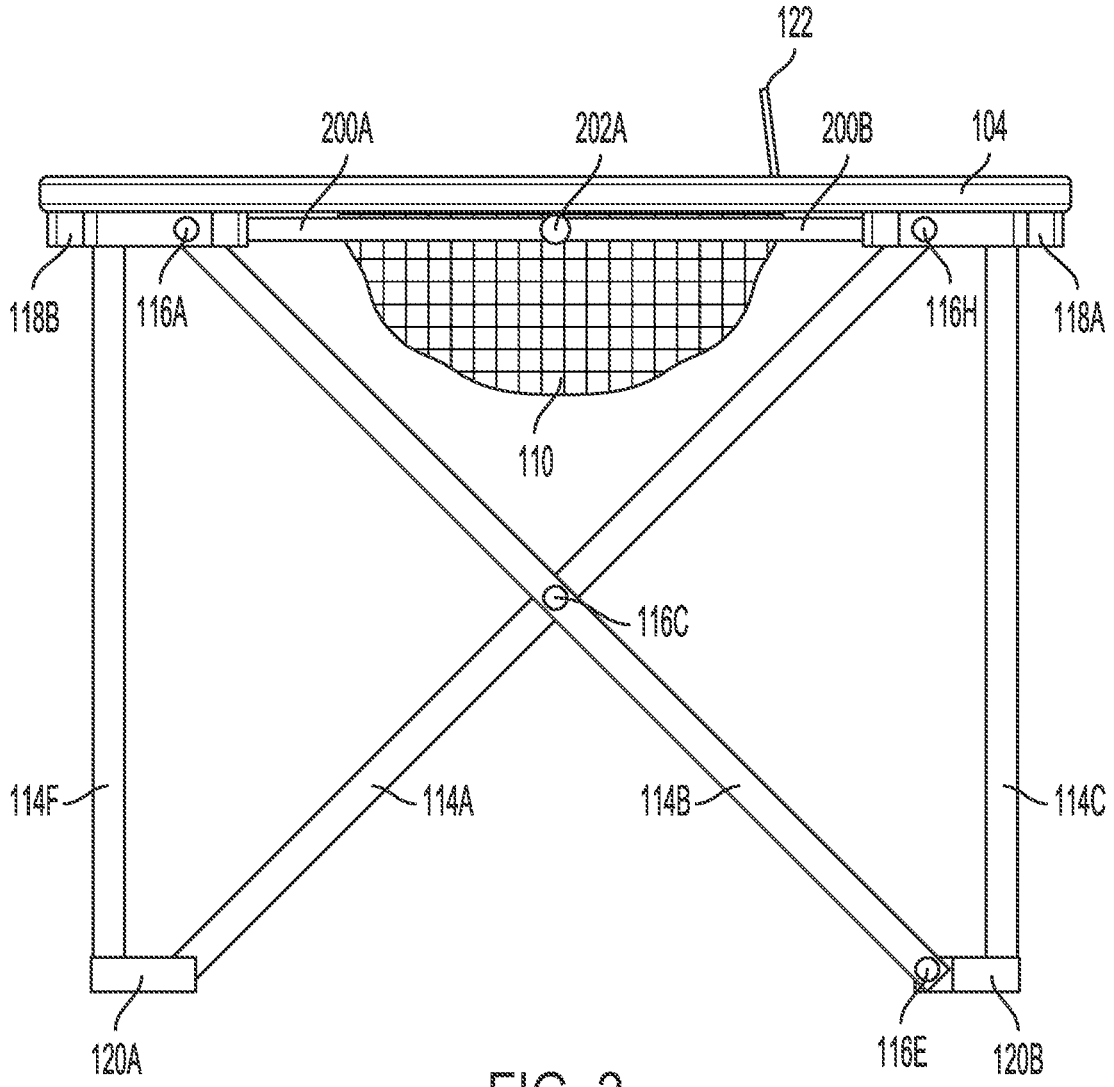
FIG. 2 illustrates a side view of the collapsible toilet chair of FIG. 1, according to an aspect of the present disclosure.
Figure 3:
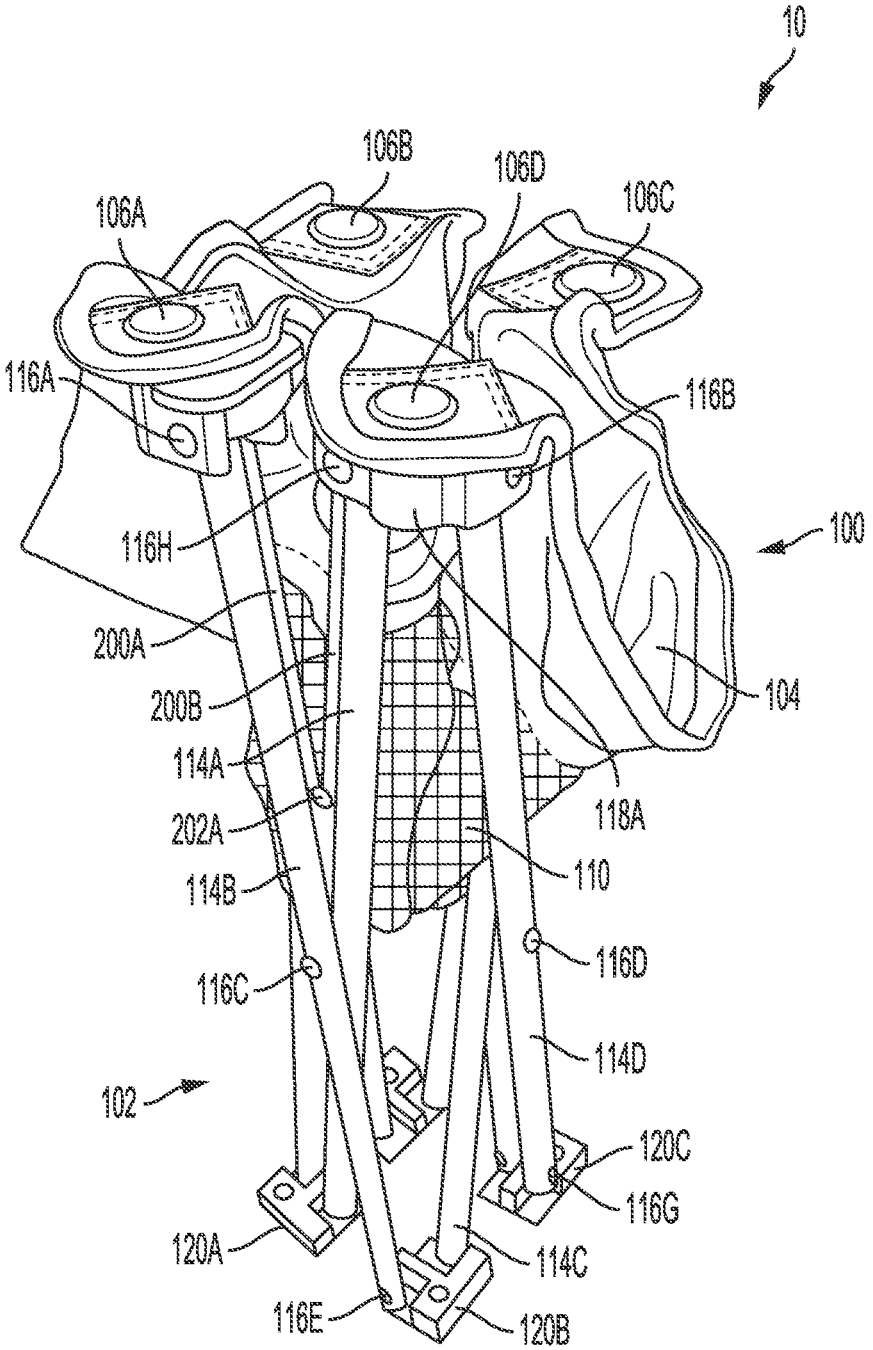
FIG. 3 illustrates a perspective view of the collapsible toilet chair of FIG. 1 in a collapsed state, according to an aspect of the present disclosure.
Figure 4:
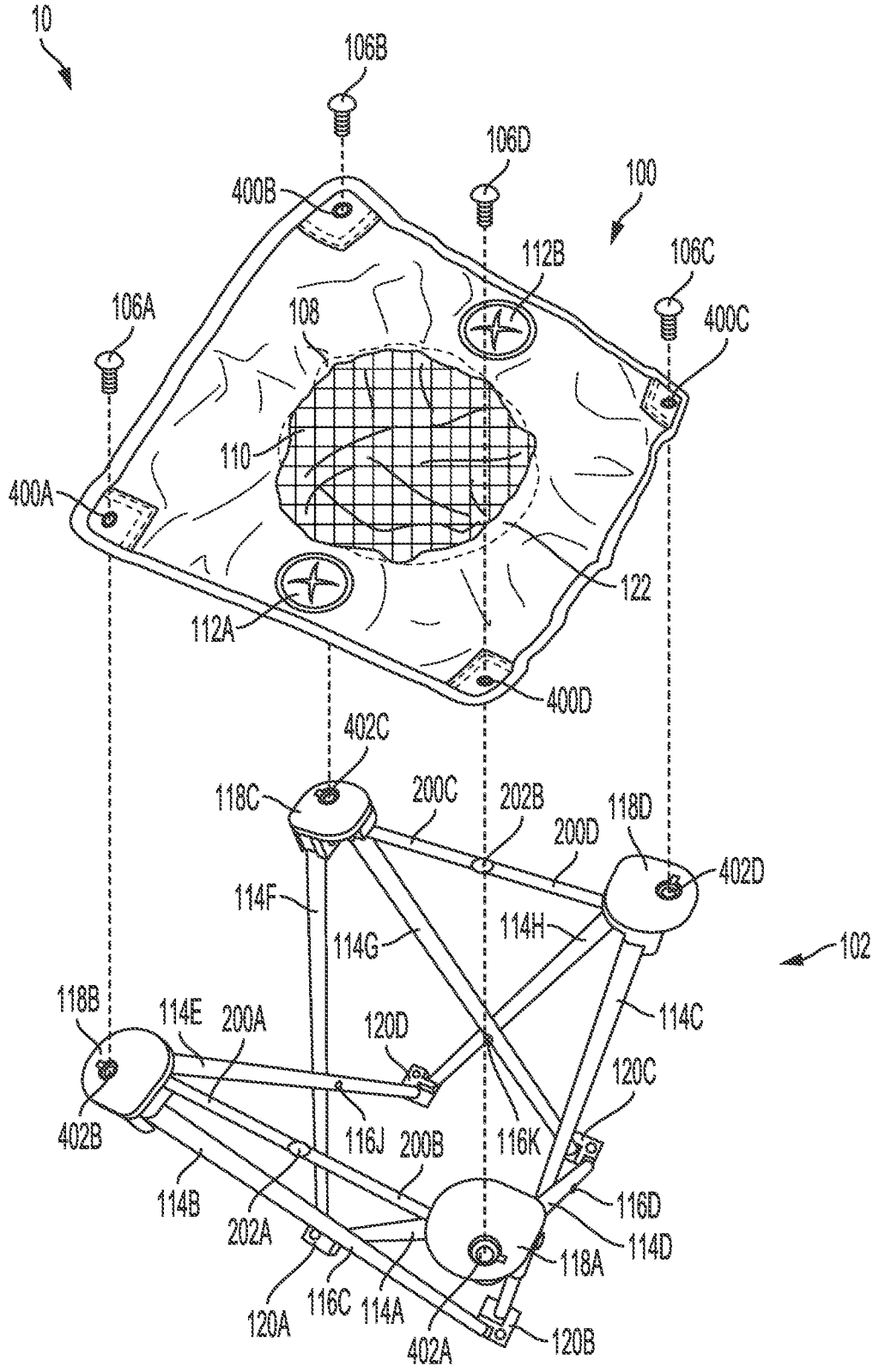
FIG. 4 illustrates an exploded view of the collapsible toilet chair of FIG. 1, according to an aspect of the present disclosure.

Embodiments of a new and innovative toilet chair are provided by the following description. The toilet chair includes a base portion and a flexible seat portion attached to the base portion. The base portion and the flexible seat portion are each movable between an extended state for use and a collapsed state for portability. For instance, the base portion is movable between the extended state and the collapsed state, and the flexibility of the attached seat portion enables the seat portion to fold up with the base portion in the collapsed state or extend with the base portion in the extended state. When in the collapsed state, the toilet chair is compact such that the toilet chair may be placed in a bag (e.g., a diaper bag) for transport. From the collapsed state, the base portion of the toilet chair may be pulled outward into the extended state, which also extends the seat portion.

The seat portion includes a flexible support member configured to support a bag (e.g., disposable bag) positioned on the seat portion to collect a child's waste. The seat portion also includes at least one (e.g., 2, 3, or 4) bag attachment member, such as a grommet, to hold the bag in place when positioned on the seat portion. With the bag held in place, a child sits directly on the seat portion of the chair and the bag collects the child's waste. The bag can be separated from the bag attachment member(s) and removed from the flexible support member after the child's waste has been collected. In some embodiments, the seat portion is removable from the base portion. Removing the seat portion from the base portion can make it easier to clean the seat portion, which can become soiled after a child uses the chair. For example, in some aspects, the seat portion is machine washable.

In various embodiments, the toilet chair is sized and shaped to be used by a child around an age that is typical for potty training (e.g., around 2-4 years old), though the toilet chair can be used by already potty-trained children. Accordingly, as used herein, a "child" refers to a child of approximately a typical age at which a child is potty trained. In some embodiments, the toilet chair can be sized and shaped for use by older children and adults. For example, such embodiments of the toilet chair may be useful for camping trips or other activities in nature without human-made facilities.

FIGS. 1 to 4 illustrate various view of an example collapsible toilet chair 10. The toilet chair 10 includes a seat portion 100 attached to a base portion 102. In at least some embodiments, the seat portion 100 is removable from the base portion 102. For example, in the depicted embodiment, screws 106A-D may be positioned through openings 400A-D in a body 104 of the seat portion 100 and into openings 402A-D in seat mounts 402A-D of the base portion 102 in order to attach the seat portion 100 to the base portion 102, and the screws 106A-D may be removed to enable removal of the seat portion 100 from the base portion 102. In other embodiments, the seat portion 100 is removably attached to the base portion 102 via snap buttons or other suitable attachment mechanisms. While the seat portion 100 does not have to be removed from the base portion 102 to collapse the toilet chair 10, removing the seat portion 100 can make it easier to clean the seat portion 100 after a child uses the toilet chair 10. For example, in some embodiments, the seat portion 100 is constructed of machine washable materials whereas the base portion 102 is not machine washable. Example materials for the body 104 of the seat portion 100 include nylon, silicone, or other suitable flexible, non-stretchable materials. In embodiments in which the body 104 is constructed of silicone, the body 104 may be cleaned by wiping the body 104 with a desired cleaning solution.

The body 104 of the seat portion 100 includes an opening 108. Extending from the body 104 at the opening 108 is a flexible support member 110 of the seat portion 100. The flexible support member 110 extends below the body 104 (i.e. in a same direction as the base portion 102) in order to create a space below a child sitting on the toilet chair 10 for the child's waste to be collected. In the depicted embodiment, the flexible support member 110 is constructed of a mesh material, though the flexible support member 110 may be non-mesh in other embodiments. Example materials for the flexible support member 110 of the seat portion 100 include nylon, silicone, or other suitable flexible, non-stretchable materials.

In an example usage scenario, a bag (e.g., disposable bag) is positioned on the seat portion 100 and into the flexible support member 110 such that the bag is supported by the flexible support member 110. To help maintain a placement of the bag, the seat portion 100 includes bag attachment members 112A and 112B. The bag attachment members 112A, 112B secure portions of the bag to the seat portion 100 so that the bag does not slide out of position as a child uses the toilet chair 10. The depicted embodiment illustrates the bag attachment members 112A, 112B as grommets having a material (e.g., rubber) cut into four triangular segments that grips a portion of a bag when the portion is slid between the triangular segments. In other embodiments, however, the bag attachment members 112A, 112B may have other suitable structures for securing a portion of a bag to the seat portion 100. Additionally, while the depicted embodiment includes two bag attachment members 112A and 112B, in other embodiments, the seat portion 100 may include any suitable quantity of bag attachment members (e.g., 1, 3, 4, etc.).

In the depicted embodiment of the toilet chair 10, the seat portion 100 further includes a protrusion 122 extending from the body 104 in a direction opposite the base portion 102 and the flexible support member 110. The protrusion 122, however, is an optional feature and some embodiments of the toilet chair 10 do not include the protrusion 122. The protrusion 122 serves as a privacy screen that conceals a child's genital area while the child uses the toilet chair 10. The protrusion 122 may be constructed of the same material as the body 104 of the seat portion 100 or another suitable material.

The base portion 102 of the example toilet chair 10 includes a plurality of support rods 114A-H (e.g., metal tubes). Each support rod 114A-H is pivotably connected to a seat mount 118A-D and to a foot mount 120A-D. For example, as shown in FIG. 1, the support rod 114D is pivotably connected to the seat mount 118A via a pivot pin 116B and to the foot mount 120C via a pivot pin 116G. As such, the support rod 114D is pivotable about an axis extending through the pivot pin 116B and about an axis extending through the pivot pin 116G. Each support rod 114A-H is also pivotably connected to another support rod 114A-H. For example, as shown in FIG. 1, the support rod 114D is pivotably connected to the support rod 114C via a pivot pin 116D. As such, the support rods 114C and 114D are each pivotable about an axis extending through the pivot pin 116D. When the base portion 102 is in an extended state, as shown in FIG. 1, the support rods 114A-H that are pivotably connected to one another (e.g., the support rods 114C and 114D) form an X-shape. FIGS. 1 to 4 do not illustrate and/or indicate with a reference numeral every pivot pin of the toilet chair 10, but rather only indicate pivot pins 116A-K with a reference numeral. One having skill in the art, however, will appreciate from the above description of the support rods 114C and 114D how each of the support rods 114A-H are structured relative to the seat mounts 118A-D, to the foot mounts 120A-D, and to each other.

In some embodiments, such as the depicted embodiment, the base portion 102 includes rods that provide support for the seat portion 100. Opposing sides of the base portion 102 may include these supporting rods for the seat portion 100. For example, the toilet chair 10 includes support rods 300A-D. The support rod 300A is pivotably connected to the seat mount 402B via a pivot pin and to the support rod 300B via a pivot pin 404A. In some aspects, the support rod 300A is pivotably connected to the seat mount 402B via the same pivot pin 116A as the support rod 114B. In other aspects, the support rod 300A is pivotably connected to the seat mount 402B via a different pivot pin than the support rod 114B. The support rod 300B is also pivotably connected to the seat mount 402A via a pivot pin (not illustrated), which may or may not be the same pivot pin 116H that pivotably connects the support rod 114A. The support rod 300C is pivotably connected to the seat mount 402C via a pivot pin and to the support rod 300D via a pivot pin 404B. In some aspects, the support rod 300C is pivotably connected to the seat mount 402C via the same pivot pin as the support rod 114GB. In other aspects, the support rod 300C is pivotably connected to the seat mount 402C via a different pivot pin than the support rod 114G. The support rod 300D is also pivotably connected to the seat mount 402D via a pivot pin (not illustrated), which may or may not be the same pivot pin that pivotably connects the support rod 114H. While the support rods 300A-D are shown between the seat mounts 118A and 118B and the seat mounts 118C and 118D, it will be appreciated that the support rods 300A-D may be between the seat mounts 118B and 118C and the seat mounts 118A and 118D in other embodiments. The pivot pins 404A and 404B may be structured the same as the pivot pins 116A-K.

As stated above, FIG. 1 illustrates the toilet chair 10 in an extended state for use by a child. The toilet chair 10 may also be collapsed to a collapsed state illustrated in FIG. 3 for portability. To collapse the toilet chair 10 from the extended state, a user can bring all of the support rods 114A-H towards the center of the toilet chair 10, for example, by pulling each of the seat mounts 118A-D towards one another. As the seat mounts 118A-D are pulled towards one another, the support rods 114A-H pivot about their respective pivot pins, which enables the toilet chair 10 to achieve the compact collapsed state shown in FIG. 3. The support rods 300A-D also pivot about their respective pivot pins such that the pivot pins 404A and 404B translate towards the foot mounts 120A-D, as can be partially seen in FIG. 3.

When the toilet chair 10 is in the collapsed state, the toilet chair 10 is compact such that the entirety of the toilet chair 10 can be conveniently stored in a bag (e.g., a diaper bag). To transition the toilet chair 10 back to the extended state from the collapsed state, a user can bring all of the support rods 114A-H away from the center of the toilet chair 10, for example, by pulling each of the seat mounts 118A-D away from one another. No part of the toilet chair 10 must be assembled or disassembled when transitioning the toilet chair 10 between the collapsed and extended states.

Figure 5:
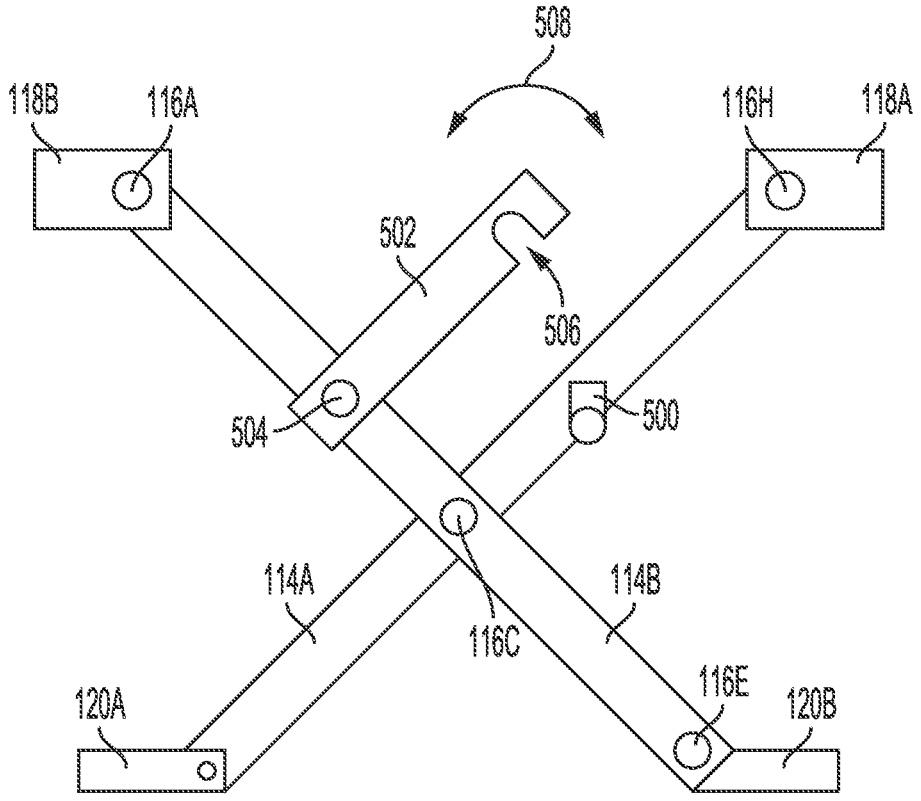
FIG. 5 illustrates a side view of an example locking mechanism that may be used with a collapsible toilet chair, according to an aspect of the present disclosure.

In some embodiments, though not illustrated in the embodiment depicted in FIGS. 1-4, the toilet chair 10 may include a locking mechanism. The locking mechanism is structured to, when engaged, maintain a position of the support rods 114A-H in the extended state so that the base portion 102 cannot transition to the collapsed state until the locking mechanism is released. FIG. 5 illustrates a side view of an example locking mechanism, though a person having skill in the art will appreciate the many suitable structures that may be used to prevent the support rods 114A and 114B from pivoting relative to one another about the pivot pin 116C. The example locking mechanism includes a peg 500 and a pivotable arm 502. The peg 500 is attached to, or integral with, the support rod 114A. The arm 502 is pivotably attached to the support rod 114B via a pivot pin 504 such that the arm 502 can pivot about the pivot pin 504 in the directions of the double-side arrow 508. The arm 502 also includes an opening 506. To engage the example locking mechanism, the arm 502 is pivoted so that the peg 500 is positioned within the opening 506, thereby preventing the support rod 114A and the support rod 114B from pivoting relative to one another about the pivot pin 116C. To release the example locking mechanism, the arm 502 is pivoted so that the peg 500 is outside of the opening 506.

In some embodiments of the example locking mechanism, the peg 500 and the arm 502 may be switched such that the support rod 114A includes the arm 502 and the support rod 114B includes the peg 500. In some embodiments, the opening 506 may be a fully enclosed opening (e.g., a circle) that is slid over an end of the peg 500 rather than open at the side of the arm 502 and slid onto a side of the peg 500 as illustrated.

FIG. 5 illustrates the example locking mechanism as a part of the support rods 114A and 114B, though it will be appreciated that the toilet chair 10 may have more than one locking mechanism. For example, in some embodiments, the toilet chair 10 may have a second locking mechanism on the opposing side of the toilet chair 10 as the support rods 114A and 114B (e.g., the support rod 114H includes a pivotable arm 502 and the support arm 114G includes a peg 500).

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

The invention is claimed as follows:

1. A collapsible toilet chair comprising:

a base member movable between an extended state and a collapsed state; and a flexible seat member attached to the base member, wherein the flexible seat member is configured to support a seated child and includes:

an opening, a flexible support member extending from the flexible seat member at the opening, and a bag attachment member configured to removably attach a first portion of a bag to the flexible seat member while a second portion of the bag is positioned against the flexible support member.

2. The collapsible toilet chair of claim 1, wherein the base member includes a plurality of support rods.

3. The collapsible toilet chair of claim 2, wherein the plurality of support rods includes a first support rod and a second support rod, wherein the first support rod is pivotable about a first pivot axis, a second pivot axis, and a third pivot axis, and wherein the second support rod is pivotable about a fourth pivot axis, the second pivot axis, and a fifth pivot axis.

4. The collapsible toilet chair of claim 3, wherein the first support rod and the second support rod form an X-shape when the base member is in the extended state.

5. The collapsible toilet chair of claim 3, wherein the base member includes a first mount and a second mount, wherein the first support rod is attached to the first mount at the first pivot axis and the second support rod is attached to the second mount at the fourth pivot axis, and wherein the flexible seat member is attached to the first and second mounts.

6. The collapsible toilet chair of claim 5, wherein the plurality of support rods further include a third support rod and a fourth support rod, the third support rod attached to and pivotable about the first mount, the fourth support rod attached to and pivotable about the second mount, and wherein the third support rod is attached to and pivotable about the fourth support rod.

7. The collapsible toilet chair of claim 1, wherein the flexible seat member is constructed of nylon.

8. The collapsible toilet chair of claim 1, wherein the flexible seat member is constructed of rubber or silicone.

9. The collapsible toilet chair of claim 1, wherein the flexible seat member is removable from the base member.

10. The collapsible toilet chair of claim 1, wherein the flexible seat member is attached to the base member via a plurality of screws.

11. The collapsible toilet chair of claim 1, wherein the flexible seat member is attached to the base member via a plurality of snap buttons.

12. The collapsible toilet chair of claim 1, further comprising a locking mechanism configured to maintain the base member in the extended state when the locking mechanism is engaged.

13. The collapsible toilet chair of claim 1, wherein the flexible seat member further includes a protrusion adjacent the opening, the protrusion extending from the flexible seat member in an opposite direction of the base member.

14. The collapsible toilet chair of claim 1, wherein the bag attachment member is a grommet.

15. The collapsible toilet chair of claim 1, wherein the bag attachment member is a first bag attachment member, the flexible seat member further including a second bag attachment member disposed on an opposing side of the flexible seat member from the first bag attachment member.

16. A collapsible toilet chair comprising:

a base member movable between an extended state and a collapsed state, wherein the base member includes a plurality of support rods including a first support rod, a second support rod, a third support rod, and a fourth support rod, wherein the first support rod is attached to and pivotable about a first mount, wherein the second support rod is attached to and pivotable about a second mount, and wherein a middle portion of the first support rod is attached to and pivotable about a middle portion of the second support rod, wherein the third support rod is attached to and pivotable about the first mount, wherein the fourth support rod is attached to and pivotable about the second mount, and wherein an end portion of the third support rod is attached to and pivotable about an end portion of the fourth support rod; and a flexible seat member removably attached to the base member, wherein the flexible seat member is configured to support a seated child and includes:

an opening, a mesh support member extending from the flexible seat member at the opening, and first and second bag attachment members configured to respectively removably attach first and second portions of a bag to the flexible seat member while a third portion of the bag is positioned against the mesh support member.

17. The collapsible toilet chair of claim 16, wherein the flexible seat member remains attached to the base member when the base member is in the collapsed state.

18. The collapsible toilet chair of claim 16, wherein the flexible seat member is configured to directly contact the seated child.

19. A system comprising:

a disposable bag; and a collapsible toilet chair including:

a base member movable between an extended state and a collapsed state, and a flexible seat member removably attached to the base member, wherein the flexible seat member is configured to support a seated child and includes:

an opening, a mesh support member extending from the flexible seat member at the opening in a same direction as the base member, and first and second bag attachment members configured to respectively removably attach first and second portions of the disposable bag to the flexible seat member while a third portion of the disposable bag is positioned against the mesh support member.

20. The system of claim 19, wherein the base member includes a plurality of support rods including a first support rod, a second support rod, a third support rod, and a fourth support rod, wherein the first support rod is attached to and pivotable about a first mount, wherein the second support rod is attached to and pivotable about a second mount, and wherein a middle portion of the first support rod is attached to and pivotable about a middle portion of the second support rod, wherein the third support rod is attached to and pivotable about the first mount, wherein the fourth support rod is attached to and pivotable about the second mount, and wherein an end portion of the third support rod is attached to and pivotable about an end portion of the fourth support rod.

* * * * *